US007116188B2

(12) United States Patent
Kawahara et al.

(10) Patent No.: US 7,116,188 B2
(45) **Date of Patent: *Oct. 3, 2006**

(54) LAMINATED DIELECTRIC FILTER, AND ANTENNA DUPLEXER AND COMMUNICATION EQUIPMENT USING THE SAME

(75) Inventors: Emiko Kawahara, Sakai (JP); Toru Yamada, Katano (JP); Hiroshi Kushitani, Izumisano (JP); Hideaki Nakakubo, Kyoto (JP)

(73) Assignee: Matsushita Electric Industrial Co., Ltd, Kadoma (JP)

( * ) Notice: Subject to any disclaimer, the term of this patent is extended or adjusted under 35 U.S.C. 154(b) by 395 days.

This patent is subject to a terminal disclaimer.

(21) Appl. No.: 10/655,098

(22) Filed: Sep. 4, 2003

(65) Prior Publication Data

US 2004/0041660 A1 Mar. 4, 2004

Related U.S. Application Data

(63) Continuation of application No. 09/631,744, filed on Aug. 4, 2000, now Pat. No. 6,696,903.

(30) Foreign Application Priority Data

Aug. 5, 1999 (JP) ..... 11-222839

(51) Int. Cl.
*H01P 1/213* (2006.01)
*H01P 1/203* (2006.01)

(52) U.S. Cl. ..... 333/134; 333/204

(58) Field of Classification Search ..... 333/204, 333/134, 185, 219
See application file for complete search history.

(56) References Cited

U.S. PATENT DOCUMENTS 4,965,537 A * 10/1990 Kommrusch ..... 333/202
5,691,674 A * 11/1997 Yorita et al. ..... 333/202
6,696,903 B1 * 2/2004 Kawahara et al. ..... 333/134

* cited by examiner

*Primary Examiner*—Stephen E. Jones
(74) *Attorney, Agent, or Firm*—Osha Liang LLP

(57) ABSTRACT

A laminated dielectric filter is formed by coupling a plurality of resonators to one another by electromagnetic-field coupling. In the laminated dielectric filter, a bypass circuit formed of a series circuit including bypass capacitors and transmission lines is provided in parallel to a magnetic-field bypass coupling between non-adjacent resonators. Thus, capacitance of the bypass capacitors can be regulated without being affected by the magnetic-field bypass coupling between the non-adjacent resonators. As a result, attenuation poles outside a passband can be controlled freely.

2 Claims, 9 Drawing Sheets

LAMINATED DIELECTRIC FILTER, AND ANTENNA DUPLEXER AND COMMUNICATION EQUIPMENT USING THE SAME

This application is a continuation of U.S. patent application Ser. No. 09/631,744 filed on Aug. 4, 2000 now U.S. Pat. No. 6,696,903, which claims priority from Japanese Patent Application No. 11-222839, filed Aug. 5, 1999.

FIELD OF THE INVENTION

The present invention relates to a filter, particularly a laminated dielectric filter, which mainly is used in high-frequency radio equipment such as portable telephones.

BACKGROUND OF THE INVENTION

Recently, with reduction in size of communication equipment, laminated dielectric filters effective for size reduction are used commonly as high-frequency filters. One example of conventional laminated dielectric filters is described with reference to drawings as follows.

FIG. 4 shows an exploded perspective view of a conventional laminated dielectric filter. The conventional laminated dielectric filter shown in FIG. 4 includes dielectric layers 301, shield electrodes 302*a* and 302*b*, resonator electrodes 303*a*, 303*b*, and 303*c*, capacitor electrodes 304*a*, 304*b*, 305*a*, 305*b*, 307*a*, 307*b*, and 307*c*, and side electrodes 308*a*, 308*b*, 308*c*, 308*d*, 309*a*, and 309*b*. In the dielectric layers 301, the shield electrode 302*a*, the resonator electrodes 303*a*, 303*b*, and 303*c*, the capacitor electrodes 304*a*, 304*b*, 305*a*, 305*b*, 307*a*, 307*b*, and 307*c*, and the shield electrode 302*b* are positioned sequentially. In addition, the side electrodes 308*a* and 308*b* on the left and right side faces of the dielectric body connect the shield electrodes 302*a* and 302*b* to form ground terminals. The side electrode 308*c* on the back face of the dielectric body connects the shield electrodes 302*a* and 302*b* and a common short-circuit end of the resonator electrodes 303*a*, 303*b*, and 303*c* to form a ground terminal. The side electrodes 308*d* on the front face of the dielectric body connect the capacitor electrodes 307*a*, 307*b*, and 307*c* corresponding to the open ends of the resonator electrodes 303*a*, 303*b*, and 303*c*, respectively. The side electrodes 309*a* and 309*b* on the left and right side faces of the dielectric body are connected to the capacitor electrodes 304*a* and 304*b* to form input/output terminals.

The structural view of the laminated dielectric filter thus configured is shown in FIGS. 5A and 5B. FIG. 5A is its left side view and FIG. 5B its front view. FIGS. 5A and 5B also show schematic capacitors formed between electrodes formed on an upper surface of a dielectric layer and electrodes formed on an upper surface of another dielectric layer, which oppose each other, respectively.

An equivalent circuit of the conventional laminated dielectric filter shown in FIGS. 4, 5A and 5B can be illustrated as shown in FIG. 6. The resonator electrodes 303*a*, 303*b*, and 303*c* form front end short-circuit ¼ wavelength resonators R303*a*, R303*b*, and R303*c* as shown in FIG. 6. The open ends of the resonators R303*a*, R303*b*, and R303*c* are connected to the ground terminals via the loading capacitor elements C307*a*, C307*b*, and C307*c*, respectively. The open ends of the resonators R303*a* and R303*b* are connected to each other via an inter-stage coupling capacitor element C305*a* and the open ends of the resonators R303*b* and R303*c* via an inter-stage coupling capacitor element C305*b*. Furthermore, the resonators R303*a* and R303*c* on the outer sides are connected to the input/output terminals via input/output coupling capacitor elements C304*a* and C304*b*, respectively.

Therefore, the laminated dielectric filter shown in FIG. 4 functions as a bandpass filter with the one ends of the capacitor elements C304*a* and C304*b* serving as the input/output ends. In addition, two attenuation poles are formed by a parallel resonance circuit formed of the inter-stage coupling capacitors C305*a* and C305*b* and magnetic-field couplings 401*a* and 401*b* occurring between the resonators R303*a* and R303*b* and between the resonators R303*b* and R303*c*. The frequencies of the attenuation poles depend on inter-stage coupling capacitance and the magnitude of the magnetic-field couplings, i.e. resonant gaps.

In the configuration as described above, however, the resonators R303*a* and R303*c* on the both sides bypass the resonator R303*b* positioned at the center to be coupled directly to each other by a magnetic-field coupling as indicated with the numeral 401*c*. Therefore, frequency characteristics of the two attenuation poles vary and thus the characteristics as designed cannot be obtained. The magnetic-field coupling 401*c* is determined uniquely when the magnetic-field couplings 401*a* and 401*b* are determined, i.e. when the resonant gaps are determined. Consequently, the two attenuation poles cannot be controlled freely while consideration is given to the magnetic-field coupling 401*c*.

SUMMARY OF THE INVENTION

The present invention is intended to provide a filter, particularly a laminated dielectric filter, allowing attenuation poles outside a passband to be controlled freely.

In one embodiment, a filter of the present invention includes a plurality of resonators coupled to one another by electromagnetic-field coupling. In the embodiment, non-adjacent resonators are electrically coupled to each other with a series circuit formed of a capacitor and a transmission line.

According to the filter of this embodiment, the capacitor formed between the non-adjacent resonators is regulated without being affected by the magnetic-field bypass coupling between the non-adjacent resonators. Thus, attenuation poles outside a passband can be controlled freely.

In the above-mentioned filter, it is preferred to electrically couple adjacent resonators to each other with a series circuit of a capacitor and a transmission line.

According to this configuration, it is possible to control at least two attenuation poles of a parallel resonance circuit formed by the electromagnetic coupling and capacitive coupling between adjacent resonators.

In the above-mentioned filter, it is preferable that the plurality of resonators and the transmission line are formed inside a dielectric body.

According to this configuration, the capacitor as a component of the filter can be formed easily by using the plurality of resonators and the transmission line as electrodes.

In another embodiment, a dielectric filter of the present invention includes a plurality of shield electrodes formed on outer faces of a dielectric body, resonator electrodes formed of at least three front end short-circuit ¼ wavelength transmission lines, a plurality of first transmission line electrodes, each of which has portions opposing respective portions of two adjacent resonator electrodes included in the resonator electrodes, and second transmission line electrodes having portions opposing the plurality of first transmission electrodes, respectively. The resonator electrodes, the first transmission line electrodes, and the second transmission line electrodes are formed between the plurality of shield electrodes.

In some embodiments, inter-stage coupling capacitors are formed between adjacent resonator electrodes and the first transmission line electrodes opposing them, and bypass capacitors are formed between the first transmission line electrodes and the second transmission line electrodes opposing them. Due to the bypass circuit formed of a series circuit including the bypass capacitors and the second transmission line electrodes, the attenuation poles outside the passband can be controlled freely by the adjustment of capacitance of the inter-stage coupling capacitors without being affected by a magnetic-field bypass coupling between non-adjacent resonator electrodes. Thus, a capacitive coupling type bandpass filter having the above-mentioned effect of controlling the attenuation freely can be obtained.

In the dielectric filter, it is preferable that the plurality of shield electrodes are connected to one another, and then are grounded.

According to this configuration, between the shield electrodes thus grounded, filter components can be positioned. Therefore, without being affected by an external electromagnetic field, desired filter characteristics can be obtained as designed.

In another embodiment, a laminated dielectric filter of the present invention has the following configuration. A first dielectric layer is laminated above a first shield electrode. On the upper surface of the first dielectric layer, resonator electrodes formed of at least three front end short-circuit ¼ wavelength transmission lines are formed. Above the resonator electrodes, a second dielectric layer is laminated. On the upper surface of the second dielectric layer, a plurality of inter-stage coupling capacitor electrodes are formed. Each of the inter-stage coupling capacitor electrodes is formed of a transmission line having portions opposing respective portions of two adjacent resonator electrodes included in the resonator electrodes. Above the inter-stage coupling capacitor electrodes, a third dielectric layer is laminated. On the upper surface of the third dielectric layer, bypass electrodes are formed. The bypass electrodes are formed of transmission lines having portions opposing the plurality of inter-stage coupling capacitor electrodes, respectively. Above the bypass electrodes, a fourth dielectric layer is laminated. On the upper surface of the fourth dielectric layer, a second shield electrode is positioned.

In some embodiments, inter-stage coupling capacitors are formed between adjacent resonator electrodes on the first dielectric layer and the inter-stage coupling capacitor electrodes on the second dielectric layer opposing the adjacent resonator electrodes. Bypass capacitors are formed between the inter-stage coupling capacitor electrodes on the second dielectric layer and the bypass electrodes on the third dielectric layer opposing them. Due to the bypass circuit of a series circuit including the bypass capacitors and the bypass electrodes, attenuation poles outside a passband can be controlled freely by the adjustment of capacitance of the inter-stage coupling capacitors without being affected by a magnetic-field bypass coupling between non-adjacent resonator electrodes. Thus, a capacitive coupling type bandpass filter having the above-mentioned effect of controlling the attenuation poles freely can be obtained.

In the above-mentioned laminated dielectric filter of the present invention, it is preferable that the first shield electrode is provided on the upper surface of a fifth dielectric layer.

In the above-mentioned laminated dielectric filter of the present invention, it is preferred to laminate a sixth dielectric layer above the second shield electrode.

According to this configuration, the sixth dielectric layer can protect the second shield electrode. In addition, it also is possible to form the same resonator electrodes as those on the first dielectric layer on the upper surface of the six dielectric layer and further laminate the same dielectric layers as the second and third dielectric layers, on the upper surfaces of which the inter-stage coupling capacitor electrodes and the bypass electrodes are formed, respectively, thus obtaining filters separated by the second shield electrode from each other.

In the above-mentioned laminated dielectric filter of the present invention, it is preferable that the first and second shield electrodes are connected to each other and then are grounded.

According to this configuration, filter components can be positioned between the first and second shield electrodes that are grounded. Therefore, desired filter characteristics can be obtained as designed without being affected by the external electromagnetic field.

In the above-mentioned dielectric filter or laminated dielectric filter of the present invention, it is preferred to include capacitor electrodes formed of the transmission lines opposing the resonator electrodes on the outermost sides and connect the capacitor electrodes to the side electrodes to form input/output terminals.

In the above-mentioned dielectric filter or laminated dielectric filter of the present invention, it is preferable that the capacitor electrodes are formed of the transmission lines opposing open ends of the resonator electrodes and are grounded.

According to this configuration, between the open ends of the resonator electrodes and the capacitor electrodes opposing them, loading capacitors as components of the bandpass filter can be formed.

Further, it is preferred to use the filter, dielectric filter, or laminated dielectric filter of the present invention in an antenna duplexer as one of or both of filters on transmission and reception sides.

According to this configuration, a conventional coaxial resonator with a high space factor, which has been used in an antenna duplexer, can be omitted. Therefore, the size of the antenna duplexer can be reduced considerably.

It also is preferred to use the filter, dielectric filter, or laminated dielectric filter of the present invention in communication equipment.

According to the various embodiments of the invention, desired characteristics can be obtained in communication equipment of limited size. Thus, the filter, dielectric filter, or laminated dielectric filter of the present invention also may contribute to the size reduction of the communication equipment.

DETAILED DESCRIPTION OF THE INVENTION

A laminated dielectric filter according to the present invention is described with reference to the drawings as follows.

Figure 1:
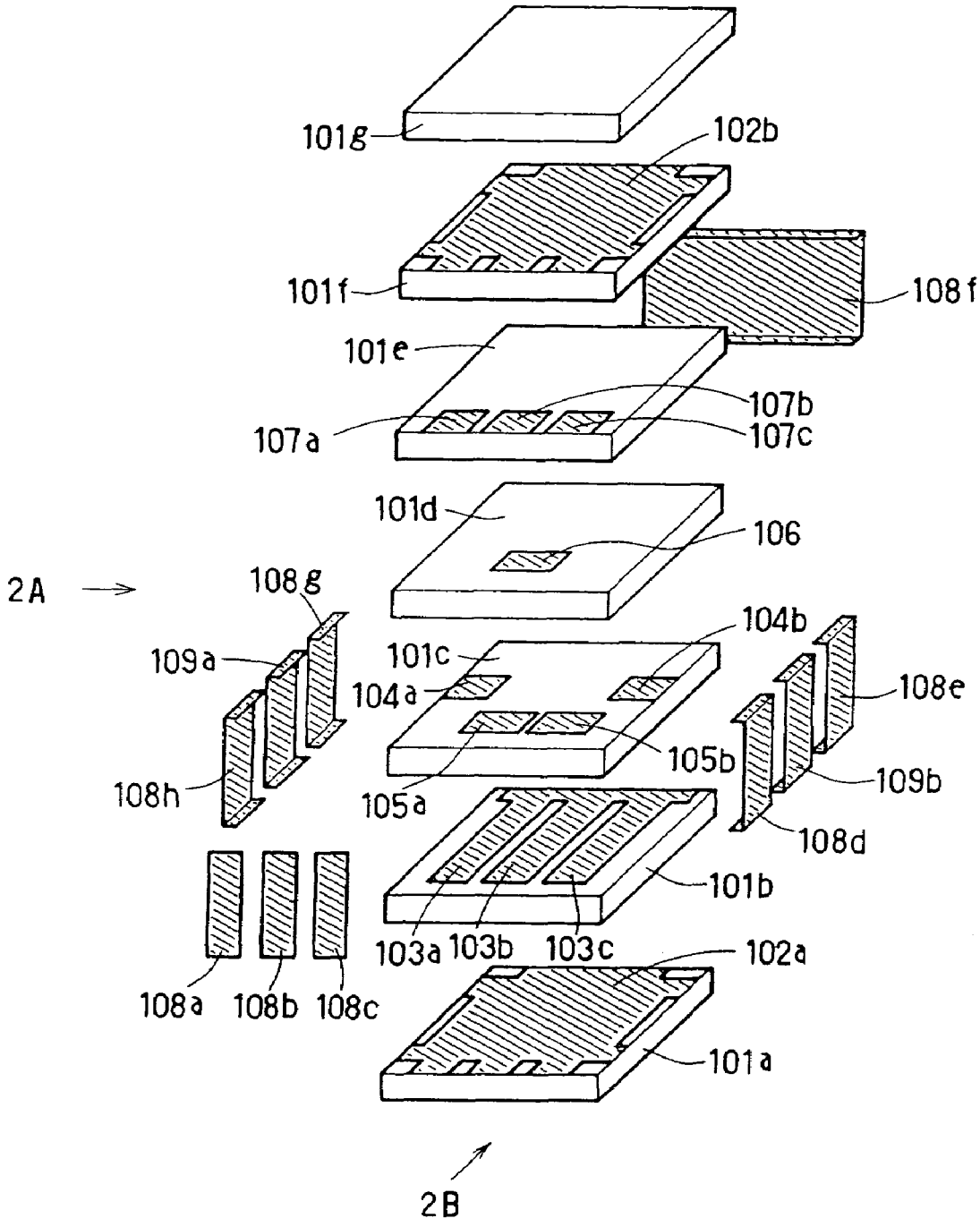
FIG. 1 is an exploded perspective view showing a structural example of a laminated dielectric filter according to an embodiment of the present invention.

FIG. 1 is an exploded perspective view of a laminated dielectric filter according to an embodiment of the present invention. In FIG. 1, numerals 101*a*, 101*b*, 101*c*, 101*d*, 101*e*, 101*f*, and 101*g* indicate dielectric layers, numerals 102*a* and 102*b* shield electrodes, numerals 103*a*, 103*b*, and 103*c* resonator electrodes, numerals 104*a*, 104*b*, 105*a*, 105*b*, 106, 107*a*, 107*b*, and 107*c* capacitor electrodes, and numerals 108*a*, 108*b*, 108*c*, 108*d*, 108*e*, 108*f*, 108*g*, 108*h*, 109*a*, and 109*b* side electrodes. The following description is directed to the laminated structure of this laminated dielectric filter. On a first dielectric layer 101*a*, a first shield electrode 102*a* is positioned, and above the electrode 102*a*, a second dielectric layer 101*b* is laminated. On the upper surface of the dielectric layer 101*b*, three resonator electrodes 103*a*, 103*b*, and 103*c* are positioned, above which a third dielectric layer 101*c* is laminated. On the upper surface of the dielectric layer 101*c*, four capacitor electrodes 104*a*, 104*b*, 105*a*, and 105*b* are positioned. Above those capacitor electrodes, a fourth dielectric layer 101*d* is laminated. On the upper surface of the dielectric layer 101*d*, a capacitor electrode 106 is positioned, and above the capacitor electrode 106, a fifth dielectric layer 101*e* is laminated. On the upper surface of the dielectric layer 101*e*, three capacitor electrodes 107*a*, 107*b*, and 107*c* are positioned. Furthermore, above these capacitor electrodes, a sixth dielectric layer 101*f* is laminated. On the upper surface of the dielectric layer 101*f*, a second shield electrode 102*b* is positioned, and above the electrode 102*b*, a seventh dielectric layer 101*g* is laminated, thus forming the laminated structure of the dielectric filters.

On the front face of the dielectric body with the above-mentioned laminated structure, the side electrodes 108*a*, 108*b*, and 108*c* are provided, and on the side faces of the dielectric body; the side electrodes 108*d* 108*e*, 108*g*, and 108*h* are provided. In addition, the side electrode 108*f* is provided on the back face of the dielectric body, and the side electrodes 109*a* and 109*b* are provided on the side faces of the dielectric body. The connections between these side electrodes and electrodes formed on the respective dielectric layers are described as follows.

The first shield electrode 102*a*, a short-circuit end on the back face side of the dielectric body at which the resonator electrodes 103*a*, 103*b*, and 103*c* are connected to one another, and the second shield electrode 102*b* are connected with the side electrode 108*f*, and then are grounded. The capacitor electrode 104*a* and the side electrode 109*a* are connected to each other and the capacitor electrode 104*b* and the side electrode 109*b* also are connected to each other. The first shield electrode 102*a*, the capacitor electrodes 107*a*, 107*b*, and 107*c*, and the second shield electrode 102*b* are connected with the side electrodes 108*a*, 108*b*, and 108*c*, and then are grounded. The first shield electrode 102*a* and the second shield electrode 102*b* are connected to each other with the side electrodes 108*d*, 108*e*, 108*g*, and 108*h*. Furthermore, the side electrodes 108*a*, 108*c*, and 108*e* and 108*g* are connected to the side electrodes 108*h*, 108*d*, and 108*f*, respectively.

Figures 2A, 2B:
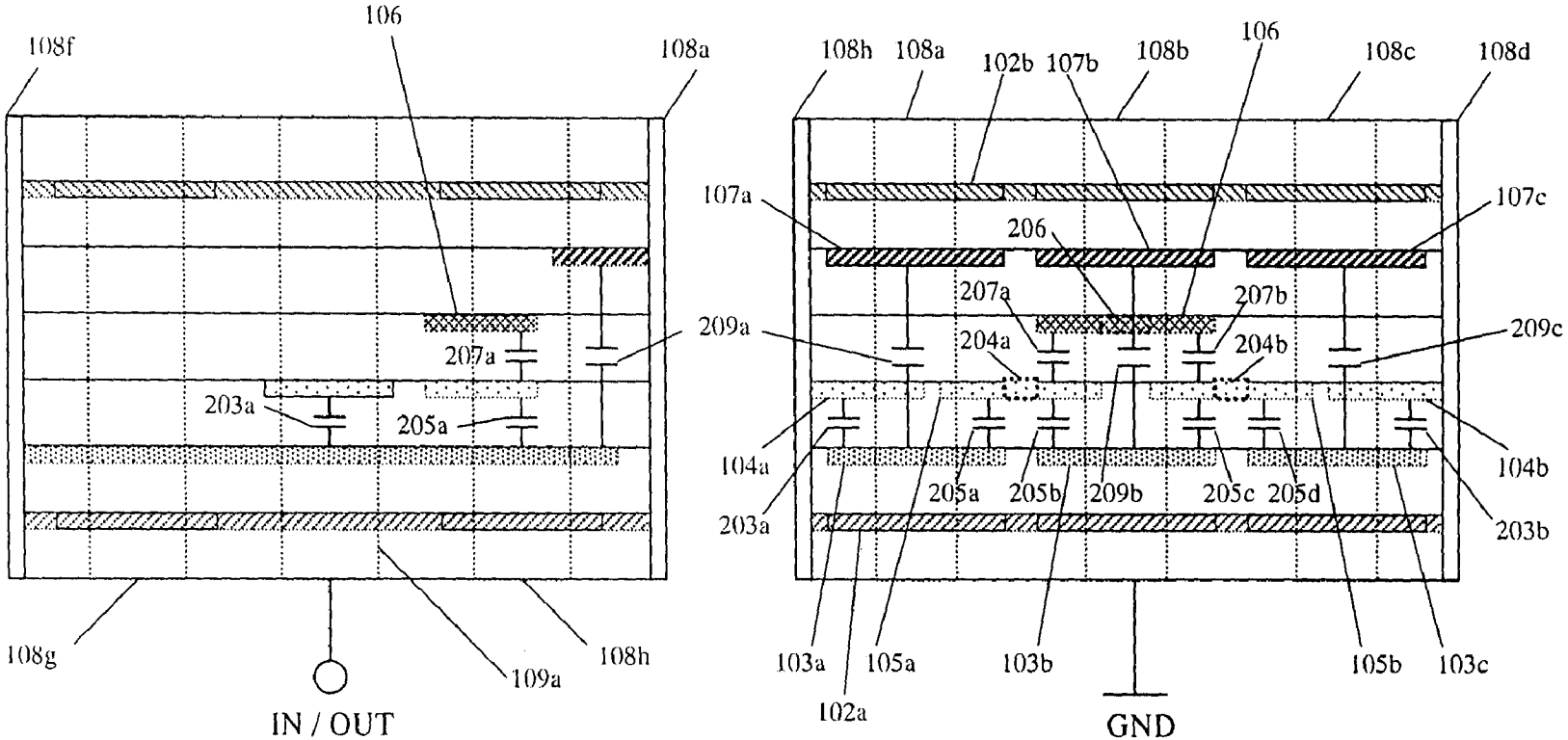
FIG. 2A is a schematic left side view showing the configuration of the laminated dielectric filter according to the present embodiment.
FIG. 2B is a schematic front view showing the configuration of the laminated dielectric filter according to the present embodiment.

The structural view of the laminated dielectric filter with the above-mentioned configuration is shown in FIGS. 2A and 2B. FIG. 2A is its left side view and FIG. 2B is its front view. FIGS. 2A and 2B also show capacitors schematically. The capacitors are formed between electrodes formed on an upper surface of a dielectric layer and electrodes formed on an upper surface of another dielectric layer, which oppose to one another.

Figure 3:
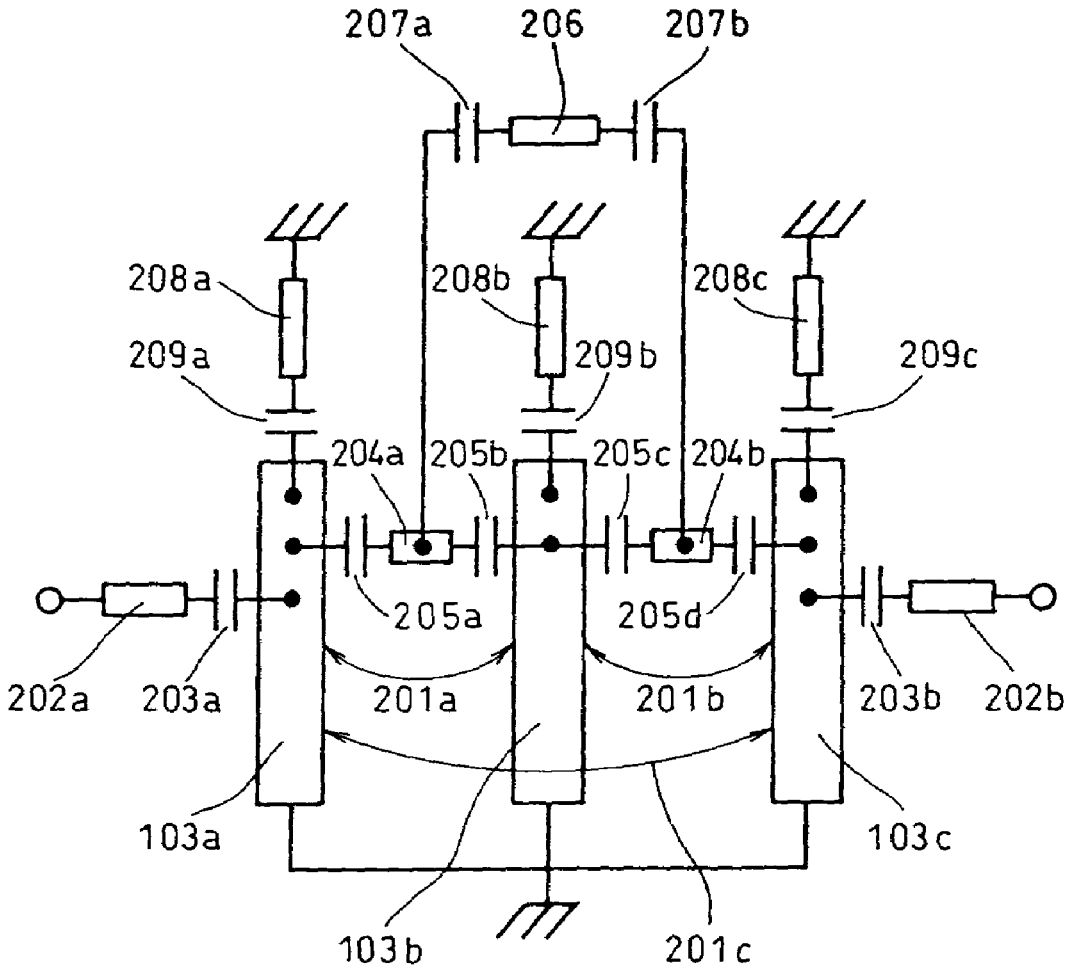
FIG. 3 is a schematic diagram of an equivalent circuit of the laminated dielectric filter according to the present embodiment.
Figure 4:
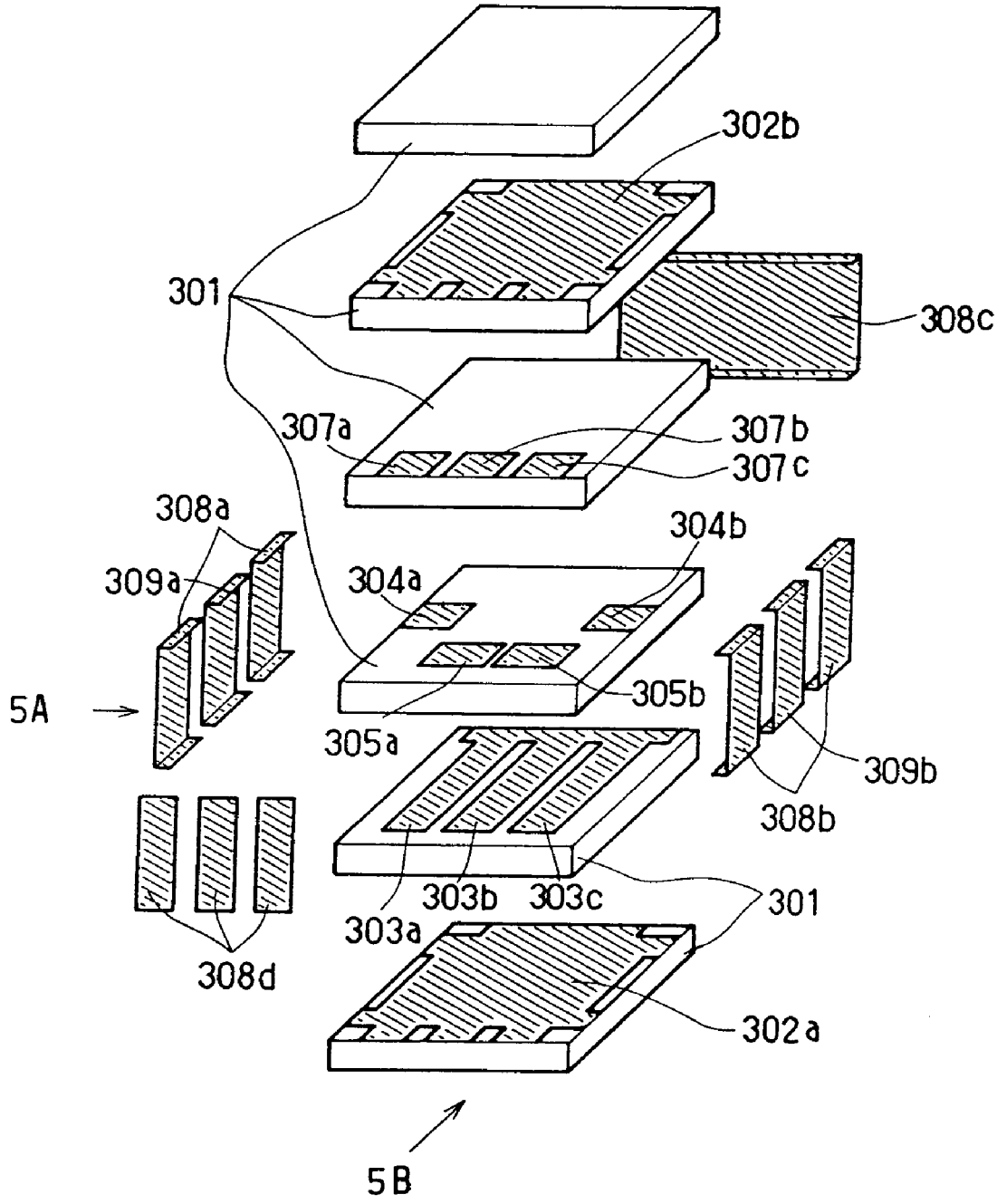
FIG. 4 (PRIOR ART)
FIG. 4 is an exploded perspective view of a conventional laminated dielectric filter.
Figure 5B:
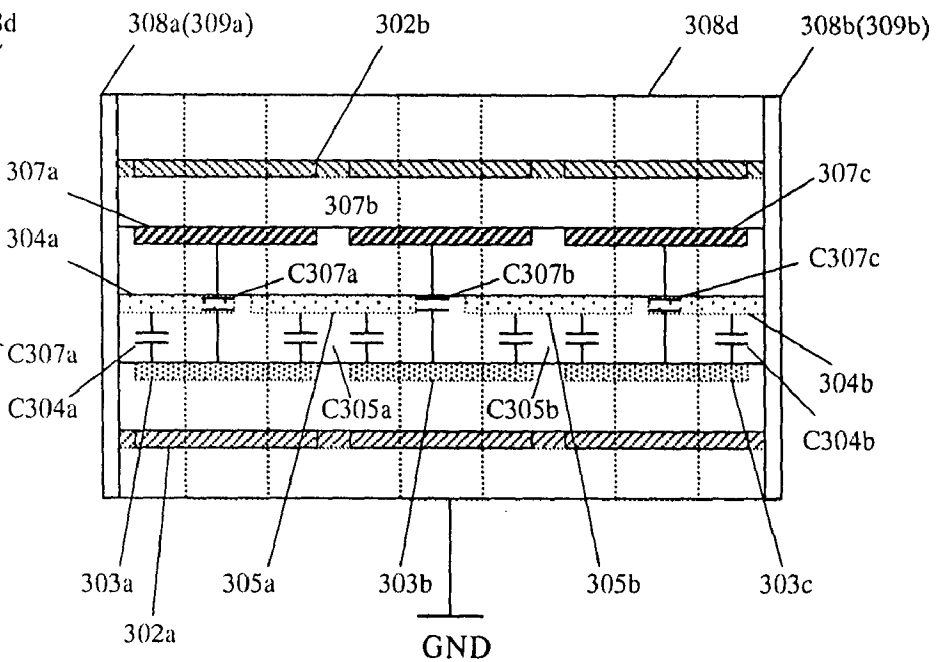
FIG. 5B (PRIOR ART)
FIG. 5B is a schematic front view showing the configuration of the conventional laminated dielectric filter.
Figure 5A:
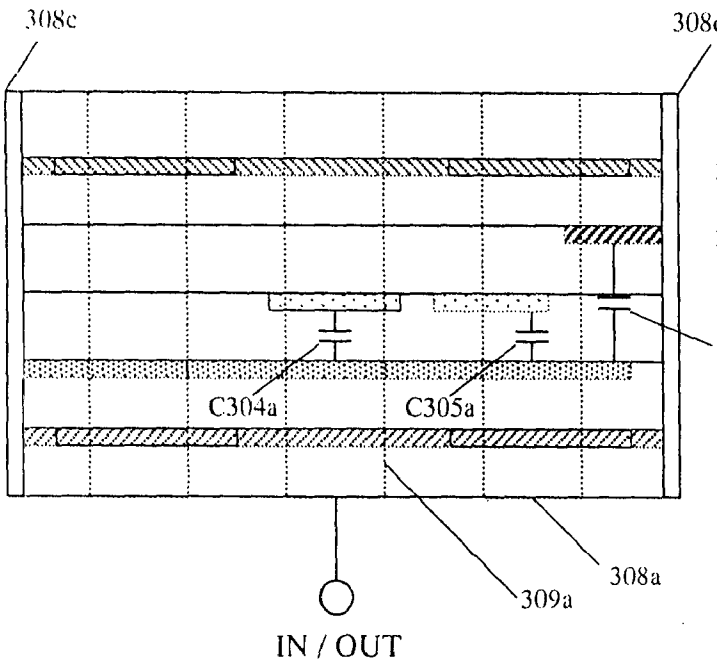
FIG. 5A (PRIOR ART)
FIG. 5A is a schematic left side view showing the configuration of the conventional laminated dielectric filter.
Figure 6:
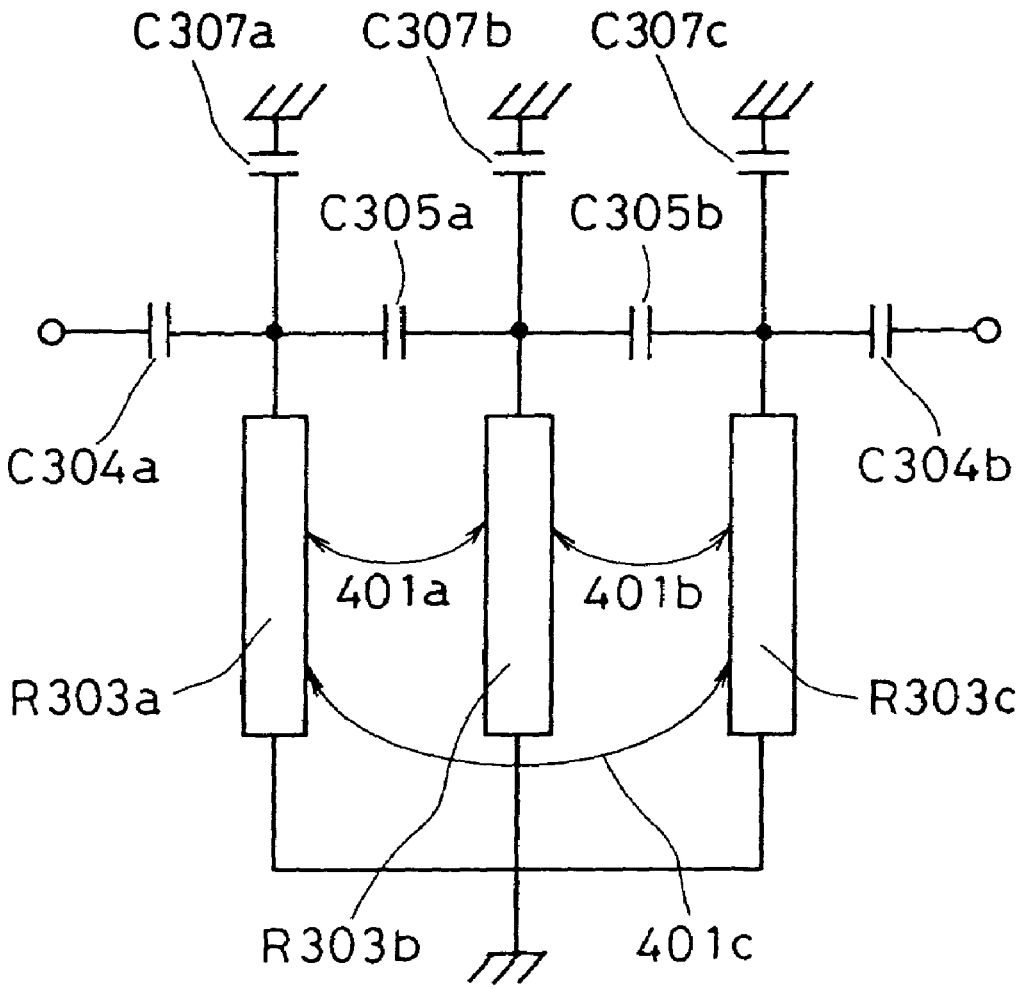
FIG. 6 (PRIOR ART)
FIG. 6 is a schematic diagram of an equivalent circuit of the conventional laminated dielectric filter.

An equivalent circuit of the laminated dielectric filter of the present invention shown in FIGS. 1, 2A, and 2B can be illustrated as in FIG. 3. In FIG. 3, portions corresponding to those in FIGS. 1, 2A, and 2B are indicated with the same numerals as in FIGS. 1, 2A, and 2B. The capacitors formed of opposed electrodes in FIGS. 1, 2A, and 2B are expressed in combination of capacitors and transmission lines while consideration also is given to the lengths of the electrodes. The operation of the laminated dielectric filter according to the present invention is described with reference to the structural views shown in FIGS. 2A and 2B and the equivalent circuit shown in FIG. 3 as follows.

The resonator electrodes 103*a*, 103*b*, and 103*c* are grounded via the side electrode 108*f* and therefore function as ¼ wavelength resonators. The capacitor electrodes 107*a*, 107*b*, and 107*c* are arranged opposing open ends of the resonator electrodes 103*a*, 103*b*, and 103*c* to form loading capacitors 209*a*, 209*b*, and 209*c* for regulating resonance frequencies of the resonators. The loading capacitors 209*a*, 209*b*, and 209*c* are grounded via transmission lines 208*a*, 208*a*, and 208*c* corresponding to the side electrodes 108*a*, 108*b*, and 108*c*.

The capacitor electrode 105*a* is arranged opposing a part of the resonator electrode 103*a* and a part of the resonator electrode 103*b*, thus forming capacitors 205*a* and 205*b* functioning as inter-stage coupling capacitors. The capacitors 205*a* and 205*b* are connected with transmission line 204*a* corresponding to the portion, which does not oppose the resonator electrodes 103*a* and 103*b*, of the capacitor electrode 105*a*.

Similarly, the capacitor electrode 105*b* is arranged opposing a part of the resonator electrode 103*b* and a part of the resonator electrode 103*c*, thus forming inter-stage coupling capacitors 205*c* and 205*d*. The capacitors 205*c* and 205*d* are connected with transmission line 204*b* corresponding to the portion, which does not oppose the resonator electrodes 103*b* and 103*c*, of the capacitor electrode 105*b*.

A bypass electrode 106 is positioned opposing the capacitor electrodes 105*a* and 105*b* to form bypass capacitors 207*a* and 207*b*. These bypass capacitors 207*a* and 207*b* are connected with a transmission line 206 corresponding to the portion, which does not oppose the capacitor electrodes

105*a* and 105*b*, of the bypass electrode 106, which functions as a bypass circuit parallel to a magnetic-field bypass coupling 201*c* between the resonator electrodes 103*a* and 103*c*.

The capacitor electrode 104*a* is positioned opposing a part of the resonator electrode 103*a* and the capacitor electrode 104*b* is positioned opposing a part of the resonator electrode 103*c*, thus forming input/output coupling capacitors 203*a* and 203*b*. These capacitors 203*a* and 203*b* are connected to the transmission lines 202*a* and 202*b* corresponding to the side electrodes 109*a* and 109*b*.

The resonance frequencies of a parallel resonance circuit formed of the bypass circuit and the magnetic-field bypass coupling 201*c* are set to be in the vicinities of the resonance frequencies of two attenuation poles formed by a parallel resonance circuit. The parallel resonance circuit is formed of magnetic-field couplings 201*a* and 201*b* occurring between the resonator electrodes 103*a* and 103*b* and between the resonator electrodes 103*b* an 103*c*, respectively, and the corresponding inter-stage coupling capacitors 205*a* and 205*b* and inter-stage coupling capacitors 205*c* and 205*d*, respectively. Thus, the impedance of the bypass circuit between the resonator electrodes 103*a* and 103*c* can be infinite in the vicinities of the resonance frequencies of the attenuation poles. Therefore, by providing the bypass circuit indicated as a series circuit formed of the transmission lines and capacitor elements, the attenuation poles outside the passband can be controlled freely by the adjustment of capacitance of the inter-stage coupling capacitors without being affected by the magnetic-field bypass coupling. Thus, a capacitive coupling type bandpass filter having the above-mentioned effect of controlling the attenuation poles freely can be obtained.

Figure 7:
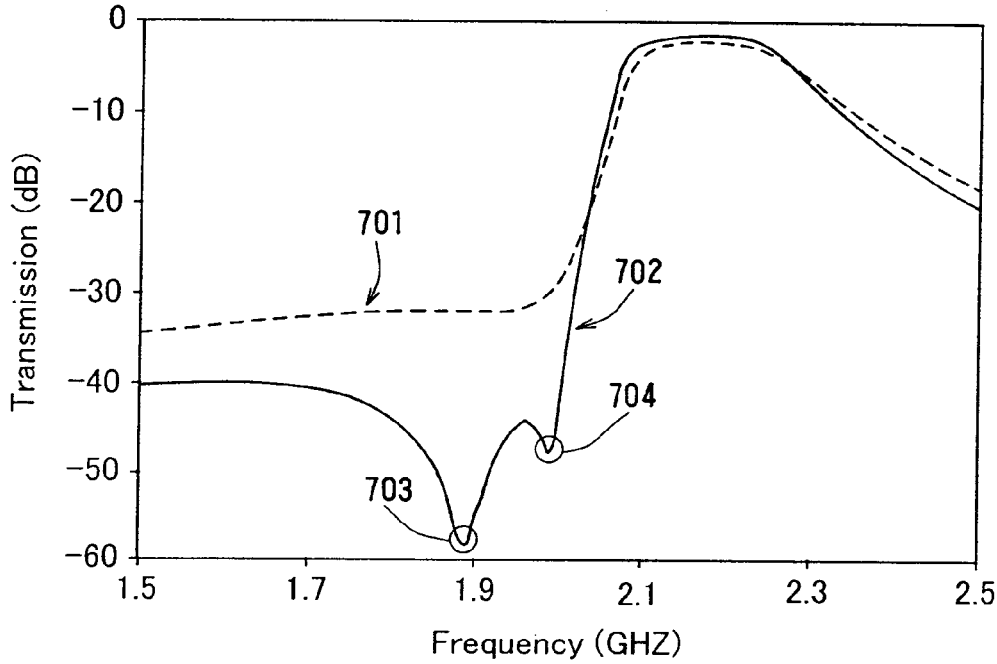
FIG. 7 is a graph showing transmission characteristics of the laminated dielectric filter according to the present invention and the conventional laminated dielectric filter.

FIG. 7 shows experimental results indicating the above-mentioned effect and illustrating the transmission characteristics of the conventional example and of the present embodiment. In FIG. 7, the attenuation amounts outside the passband in the conventional example and the present embodiment are compared. Numeral 701 indicates the transmission characteristics of the conventional laminated dielectric filter. On the other hand, numeral 702 indicates the transmission characteristics of the laminated dielectric filter according to an embodiment of the present embodiment. It can be seen that steep and high attenuation characteristics can be obtained due to the control of the two attenuation poles 703 and 704.

As described above, according to the present embodiment, the bypass circuit formed of a series circuit including capacitor elements and transmission lines is provided in parallel to the magnetic-field bypass coupling, which enables the attenuation poles outside the passband to be controlled freely. Thus, a bandpass filter with steep attenuation characteristics as designed can be obtained.

In the present embodiment, a bandpass filter including the three-stage magnetic-field bypass coupling was described. However, the same effect also can be obtained in a filter having a configuration in which the bypass between the input and output terminals are achieved by using four stages or more or two stages.

Figure 8:
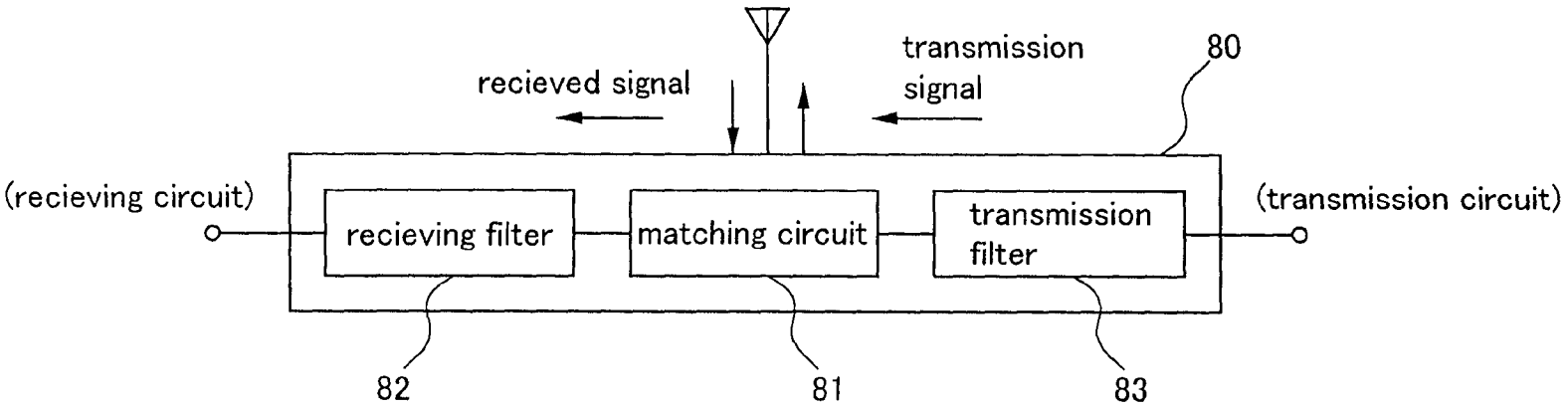
FIG. 8 is a block diagram of an antenna duplexer using a laminated dielectric filter according to the present embodiment.

In addition, as shown in FIG. 8, when the laminated dielectric filter of the present embodiment is placed at each end of a matching circuit 81 connected to an antenna as a receiving filter 82 or a transmission filter 83, a conventional large coaxial resonator with a high space factor that has been used in an antenna duplexer can be omitted, thus obtaining an antenna duplexer 80 with a highly reduced size.

Figure 9:
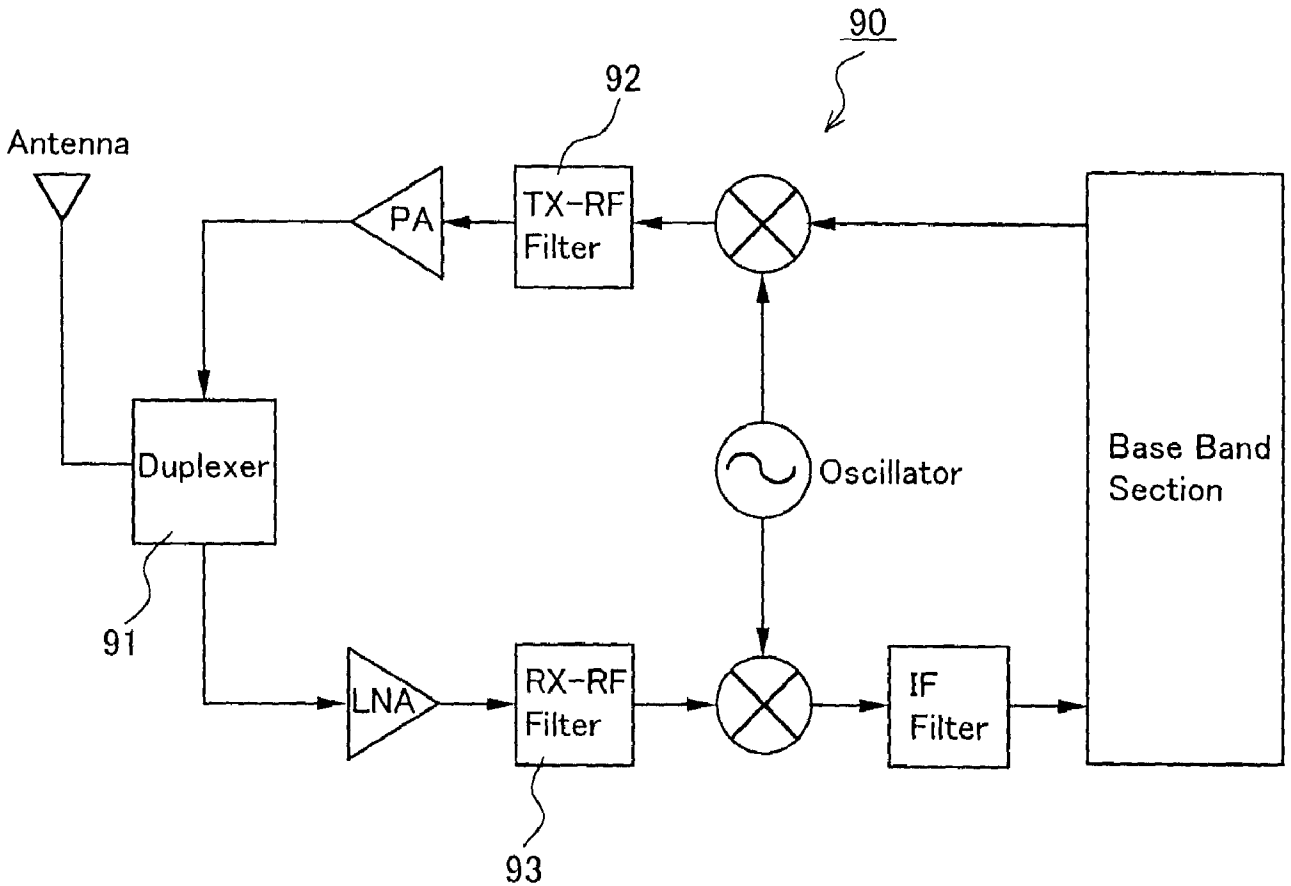
FIG. 9 is a block diagram of communication equipment using a laminated dielectric filter according to the present embodiment.

Moreover, when the laminated dielectric filter of the present embodiment is used for one of or all of a duplexer 91 and RF filters 92 and 93 in communication equipment 90 such as portable telephones or the like as shown in FIG. 9, desired characteristics can be obtained in communication equipment with a limited size. Thus, the laminated dielectric filter of the present embodiment also contributes to the size reduction of the communication equipment.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An antenna duplexer, comprising a filter including a plurality of resonators, the resonators being coupled to one another by electromagnetic-field coupling, wherein non-adjacent resonators of said plurality of resonators are electrically coupled to each other with a bypass circuit formed of a bypass capacitor and a non-grounded transmission line, the bypass circuit functioning as a capacitive coupling parallel to a magnetic-field bypass coupling between non-adjacent resonators;

wherein adjacent resonators of said plurality of resonators are electrically coupled to each other with a series circuit formed of an inter-stage capacitor and a transmission line, each series circuit functioning as a capacitive coupling parallel to a magnetic-field coupling between the adjacent resonators;

wherein the plurality of resonators and the transmission line are formed inside a dielectric body; and wherein the filter is used as one of or both of filters on transmission and reception sides.

2. Communication equipment, comprising a filter including a plurality of resonators, the resonators being coupled to one another by electromagnetic-field coupling, wherein non-adjacent resonators of said plurality of resonators are electrically coupled to each other with a bypass circuit formed of a bypass capacitor and a non-grounded transmission line, the bypass circuit functioning as a capacitive coupling parallel to a magnetic-field bypass coupling between non-adjacent resonators;

wherein adjacent resonators of said plurality of resonators are electrically coupled to each other with a series circuit formed of an inter-stage capacitor and a transmission line, each series circuit functioning as a capacitive coupling parallel to a magnetic-field coupling between the adjacent resonators; and wherein the plurality of resonators and the transmission line are formed inside a dielectric body.

* * * * *